United States Patent [19]

Hoot

[11] 4,085,785

[45] Apr. 25, 1978

[54] INFLATABLE COOLER CONTAINER

[75] Inventor: Eric F. Hoot, Cambridge, Canada

[73] Assignee: The Raymond Lee Organization Inc., New York, N.Y. ; a part interest

[21] Appl. No.: 729,280

[22] Filed: Oct. 4, 1976

[51] Int. Cl.[2] ..... B65D 31/04

[52] U.S. Cl. ..... 150/.5; 150/1

[58] Field of Search ..... 150/.5, 1; 220/17

[56] References Cited

U.S. PATENT DOCUMENTS

| | | | |
|---|---|---|---|
| 2,580,879 | 1/1952 | Belokin | 150/.5 |
| 2,751,953 | 6/1956 | Grimm | 150/.5 |
| 3,006,396 | 10/1961 | Cushman | 150/.5 |
| 3,347,060 | 10/1967 | Barkan | 150/.5 |
| 3,742,994 | 7/1973 | Pensak | 150/.5 |
| 3,765,559 | 10/1973 | Sauey | 220/17 |
| 3,910,461 | 10/1975 | Eager | 220/17 |

FOREIGN PATENT DOCUMENTS

| | | | |
|---|---|---|---|
| 1,208,104 | 12/1958 | France | 150/.5 |
| 1,013,970 | 12/1965 | United Kingdom | 150/.5 |

*Primary Examiner*—Ro E. Hart

*Attorney, Agent, or Firm*—Howard I. Podell

[57] ABSTRACT

An inflatable container for storage of foods under insulated conditions. The container is formed of a removable heavy gauge plastic liner which fits inside of an open inflated box structure fitted with an inflated cover. The inflatable box structure and cover are each made of ribbed flexible material joined as walls to enclose an inflatable chamber and fitted with an orifice and a sealing cap. The inflated chamber serves as an insulation medium for maintenance of the contents of the liner at reduced or elevated temperatures from ambient conditions.

1 Claim, 3 Drawing Figures

INFLATABLE COOLER CONTAINER

SUMMARY OF THE INVENTION

My invention is an inflatable container for storage of foods under insulated conditions. The container is formed of a removable heavy gauge plastic liner which fits inside of an open inflated box structure fitted with an inflated cover. The inflatable box structure and cover are each made of tibbed flexible material joined as walls to enclose an inflatable chamber and fitted with an orifice and a sealing cap. The inflated chamber serves as an insulation medium for maintenance of the contents of the liner at reduced or elevated temperatures from ambient conditions.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
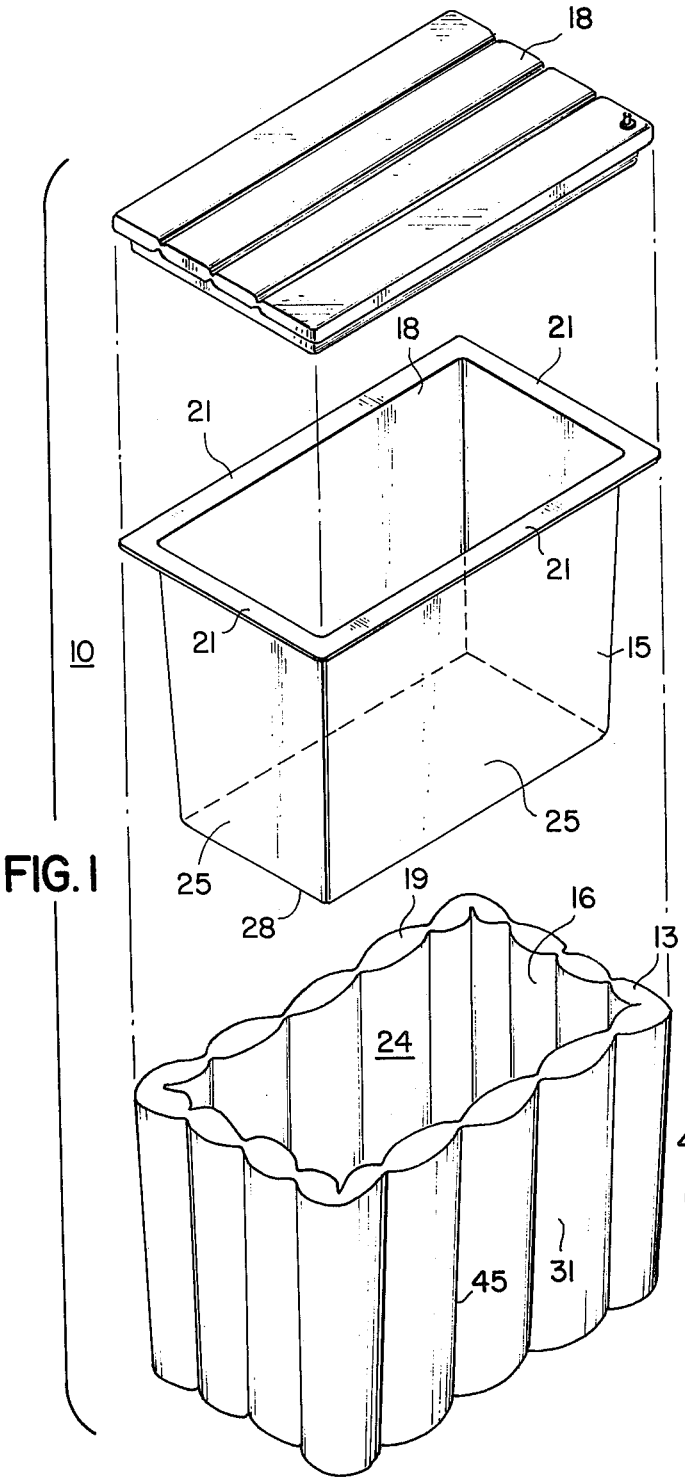
FIG. 1 is an exploded perspective view of the invention.
Figure 2:
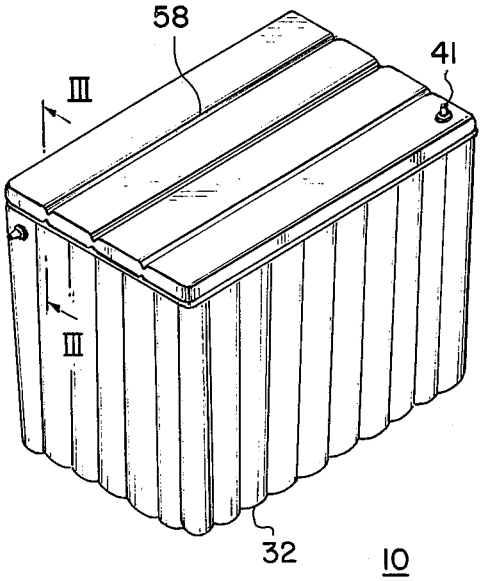
FIG. 2 is a perspective view of the invention.
Figure 3:
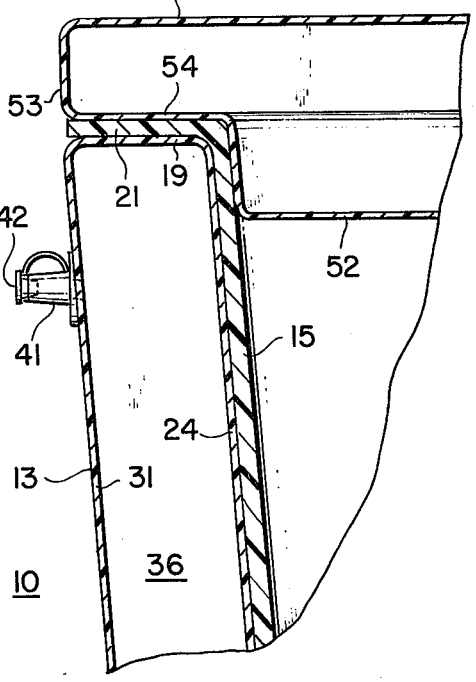
FIG. 3 is a sectional view of the invention, taken along line 3—3 of FIG. 2.

Turning now descriptively to the drawings, in which similar reference characters denote similar elements throughout the several views, FIGS. 1-3 illustrate the cooler assembly 10 which is formed of a plastic liner shaped as a pail 11 of rectangular cross-section that fits within the interior 16 of an inflatable box structure 13, open to the top, with an inflatable cover 18 that snugly fits within the interior of the top inner edge 18 of the pail 11 and extends over the top edges 19 of the box structure.

Pail 15 is formed along its top rim with a flange 21 that extends about the top edge wall 19 of the box structure so as to be supported by nesting against the said top wall 19, and wedging against the inner side walls 24 and resting on the inner bottom wall of the box structure, with the vertical walls 25 of the pail inclined from the juncture with pail flange 21 inwards to join a bottom pail wall 28 of less area than the area of the pail opening bounded by flanges 21.

Box structure 13 is formed of continuous flexible impermeable material forming an outer wall 31 joined to a similar outer bottom wall 32, with the outer wall 31 joined to a similar inner wall 24 and inner bottom wall, with the inner wall 24 joined to the outer wall 31 by a continuous top edge wall 19, with said walls separating from each other when the interior chamber 36 bounded by said walls is inflated by compressed air through inlet 41 valve mounted in a wall 31 which valve is closed by a cap 42.

The outer walls and inner walls 24 are formed with spaced vertical ribs 45 which may be fitted with reinforcement tape to maintain the inflated shape of the box structure.

Cover 18 is formed of flexible impermeable material formed as an outer wall 51 joined to an inner wall 52 by an end wall 53 joined to a flanged wall section 54 that fits about flange 19 and inner flange edge 18 of pail 15, and is similarly fitted with a valve 41 for inflating the chamber between walls 51 and 52. The outer wall 51 of the cover is formed with parallel reinforced ribs 58.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A collapsible inflatable container for use, when inflated, as a thermal insulated container in the form of an inflatable box structure, open to the top, fitted with a removable inflatable cover, in which the box structure is formed of a continuous flexible inner side wall joined to an inner flexible bottom wall, and a continuous flexible outer side wall joined to an outer flexible bottom wall, with the said inner side wall joined to the said outer side wall by a continuous top edge wall, and with an inlet valve mounted in a said wall for use in inflating with air the spacing between said inner and said outer walls, and in which the cover is formed with a continuous flexible outer wall joined to a continuous flexible inner wall by a flexible end wall, with said end wall shaped so as to form a flanged wall section of a shape to detachably fit over the top edge wall of the box structure and about an adjoining portion of the inner side wall of the inflated box structure, when the interior spacing between the said cover outer and inner walls are inflated with air, together with valve means fitted to the cover for inflating said interior spacing, together with a plastic liner shaped as a pail of a size to detachably fit inside the said box structure and formed with a flange shaped to fit between the adjacent surfaces of the box structure and the cover, in the installed position of the liner and inflated cover to the inflated box structure.

* * * * *